US010707010B2

(12) United States Patent
Chen

(10) Patent No.: US 10,707,010 B2
(45) Date of Patent: Jul. 7, 2020

(54) METHODS TO SPRAY PAINT ON A BODY OF AN INDUCTOR

(71) Applicant: CYNTEC CO., LTD., Hsinchu (TW)

(72) Inventor: Sen-Huei Chen, Yunlin County (TW)

(73) Assignee: CYNTEC CO., LTD., Hsinchu (TW)

( * ) Notice: Subject to any disclaimer, the term of this patent is extended or adjusted under 35 U.S.C. 154(b) by 396 days.

(21) Appl. No.: 15/585,176

(22) Filed: May 3, 2017

(65) Prior Publication Data

US 2017/0323720 A1 Nov. 9, 2017

Related U.S. Application Data

(60) Provisional application No. 62/331,991, filed on May 5, 2016.

(51) Int. Cl.

| | |
|---|---|
| ***H01F 27/32*** | (2006.01) |
| ***H01F 1/153*** | (2006.01) |
| ***H01F 7/02*** | (2006.01) |
| ***H01F 27/02*** | (2006.01) |
| ***H01F 41/00*** | (2006.01) |
| ***H01F 17/04*** | (2006.01) |
| ***H01F 27/29*** | (2006.01) |
| *H01F 3/10* | (2006.01) |
| *H01F 41/076* | (2016.01) |

(52) U.S. Cl.

CPC ..... *H01F 27/321* (2013.01); *H01F 1/15383* (2013.01); *H01F 7/0221* (2013.01); *H01F 17/04* (2013.01); *H01F 27/022* (2013.01); *H01F 27/29* (2013.01); *H01F 41/005* (2013.01); *H01F 41/076* (2016.01); *H01F 2003/106* (2013.01); *H01F 2017/048* (2013.01)

(58) Field of Classification Search

CPC ..... H01F 17/00; H01F 17/0006; H01F 17/02; H01F 17/03; H01F 27/29; H01F 41/04; H01F 41/041; H01F 1/15383; H01F 7/0221; H01F 27/022; H01F 27/321; H01F 41/005; H01F 41/076; H01F 2003/106; H01F 2017/048

See application file for complete search history.

(56) References Cited

FOREIGN PATENT DOCUMENTS

| | | | |
|---|---|---|---|
| JP | 04257208 A | * | 9/1992 |
| JP | 20022203721 A | * | 7/2002 |
| JP | 2006100738 A | * | 4/2006 |

* cited by examiner

*Primary Examiner* — Carl J Arbes
(74) *Attorney, Agent, or Firm* — Min-Lee Teng; Litron Patent & Trademark Office

(57) ABSTRACT

Multiple methods are provided to paint a body of an inductor so that there is no residual glue remained in the lead that may cause extra cleaning work and soldering issues when the lead is soldered with an external circuit.

14 Claims, 8 Drawing Sheets

METHODS TO SPRAY PAINT ON A BODY OF AN INDUCTOR

CROSS-REFERENCES TO RELATED APPLICATIONS

This application claims the benefit of U.S. Provisional Patent Application No. 62/331,991 filed on May 5, 2016, which is hereby incorporated by reference herein and made a part of specification.

BACKGROUND OF THE INVENTION

I. Field of the Invention

The present invention relates to an inductor, and in particularly, to spray paint on a body of an inductor.

II. Description of the Prior Art

Conventional way to spray paint on all side surfaces of the body of an inductor uses an adhesive tape to cover the leads of the inductor, which will cause extra cleaning work to remove the glue after the tape is removed.

Please refer to FIG. 1, which illustrates views of conventional steps to form a paint-coating layer on the magnetic body of an inductor, wherein a view 101 shows the inductors are made and are arranged on a frame before spraying paint on all surfaces of the magnetic body of each inductor; a view 102 shows the leads of inductors on the frame are covered by a tape, wherein the tape is adhered to the leads by using a tape that has adhesive material on its bottom surface; and then spraying paint on the magnetic body to encapsulate all surfaces of the magnetic body of the inductor; and after the magnetic body is coated with the paint, the tape will be removed; a view 103 shows the inductors arranged on a frame after the magnetic body is coated with the paint for baking so that the paint can be heated and stayed on the magnetic body of each inductor. However, this conventional method uses sticky tape, and there is a need to remove the glue after the sticky tape is removed, so it might cause structural damage to body or the leads of the inductor. By doing so, it will cost more time and more cost to clean the residual glue on the leads of the inductor.

Accordingly, the present invention proposes a better way to coat the paint on the body of the inductor to overcome the above-mentioned problems.

SUMMARY OF THE INVENTION

One objective of the present invention is to provide a method to paint a body of an inductor so that there is no residual glue remained in the lead that may cause extra cleaning work and soldering issues when the lead is soldered with an external circuit.

One objective of the present invention is to provide a method to paint a body of an inductor so that the lead of the inductor will not have any paint stains that may cause soldering issues when the lead is soldered with an external circuit.

One embodiment of the present invention is to provide a method to paint a body of an inductor, wherein a first lead extends out from a first side surface of the body, the method comprising: spraying paint on all surfaces of the body of the inductor and on the first lead; and covering the first lead with a mask to define a first area of a first surface of the first lead; and removing the paint on the first area of the first surface of the first lead by a laser beam.

In one embodiment, a second lead extends out from a second side surface of the body of the inductor, wherein the first lead and the second lead extends outside of the body from two opposite side surfaces of the body, wherein at least one portion of the second lead is covered by the paint, further comprising: covering the second lead with the mask to define a first area of a first surface of the second lead; and removing the paint on the first area of the first surface of the second lead by the laser beam.

In one embodiment, the body is a magnetic body, and a coil is embedded inside the magnetic body and electrically connected to the first lead and the second lead.

In one embodiment, the body is a magnetic body, and a metal strip is embedded inside the magnetic body and electrically connected to the first lead.

In one embodiment, the body is a magnetic body, and a metal strip is embedded inside the magnetic body and electrically connected to the first lead and the second lead.

One embodiment of the present invention is to provide a method to paint a body of an inductor, wherein a first lead extends out from a first side surface of the body, the method comprising: covering the first lead with a first object, wherein said first object is not adhered to the first lead; spraying paint on all surfaces of the body of the inductor; and removing said first object to expose the first lead.

In one embodiment, said object is a non-adhesive tape;

In one embodiment, said object is a non-adhesive fixture;

In one embodiment, the inductor further comprises a second lead extending outside the body of the inductor, wherein the first lead and the second lead extends outside of the body from two opposite side surfaces of the body, the method further comprising covering the second lead with a second object, wherein the second object is not adhered to the second lead; and removing said second object to expose the second lead.

In one embodiment, said first object and said second object are integrally formed in one piece.

In one embodiment, said first object is a non-adhesive tape.

In one embodiment, said first object is a non-adhesive fixture.

In one embodiment, the body is a magnetic body, and a coil is embedded inside the magnetic body and electrically connected to the first lead and the second lead.

In one embodiment, the body is a magnetic body, and a metal strip is embedded inside the magnetic body and electrically connected to the first lead.

In one embodiment, the body is a magnetic body, and a metal strip is embedded inside the magnetic body and electrically connected to the first lead and the second lead.

One embodiment of the present invention is to provide a method to paint a body of an inductor, wherein a first lead extends out from a first side surface of the body, the method comprising: using an ultrasonic equipment to spray paint on all surfaces of the body of the inductor, wherein the lead is not covered while spraying the paint using the ultrasonic equipment.

In one embodiment, a second lead extends out from a second side surface of the body of the inductor, wherein the first lead and the second lead extends outside of the body from two opposite side surfaces of the body, wherein at least one portion of the second lead is covered by the paint, further comprising: covering the second lead with the mask to define a first area of a first surface of the second lead; and removing the paint on the first area of the first surface of the second lead by the laser beam.

In one embodiment, the body is a magnetic body, and a coil is embedded inside the magnetic body and electrically connected to the first lead and the second lead.

In one embodiment, the body is a magnetic body, and a metal strip is embedded inside the magnetic body and electrically connected to the first lead.

In one embodiment, the body is a magnetic body, and a metal strip is embedded inside the magnetic body and electrically connected to the first lead and the second lead.

The detailed technology and above preferred embodiments implemented for the present invention are described in the following paragraphs accompanying the appended drawings for people skilled in the art to well appreciate the features of the claimed invention.

BRIEF DESCRIPTION OF THE DRAWINGS

The foregoing aspects and many of the accompanying advantages of this invention will become more readily appreciated as the same becomes better understood by reference to the following detailed description when taken in conjunction with the accompanying drawings, wherein.

DETAILED DESCRIPTION OF THE INVENTION

The detailed explanation of the present invention is described as follows. The described preferred embodiments are presented for purposes of illustrations and descriptions, and they are not intended to limit the scope of the present invention.

The present invention discloses different methods to form a paint-coating layer on a magnetic body of an inductor by spraying paint on the magnetic body to encapsulate all surfaces of the magnetic body of the inductor as well as an inductor that has the paint-coating layer.

The following embodiments discloses different methods to form a paint-coating layer on a magnetic body of an inductor by spraying paint on the magnetic body to encapsulate all surfaces of the magnetic body of the inductor as well as an inductor that has the paint-coating layer.

First Embodiment

The method described in this embodiment is intended to improve the drawbacks of using an adhesive tape to stick on leads of inductors so that the leads can be protected while performing spraying paint on six-sided surfaces of a magnetic body of an inductor, wherein the material of the paint can be polymer and adhesive material, such as resin. The method described in this embodiment can be applied to various sizes or shape of the leads or the magnetic body of an inductor or a choke.

Figure 1:
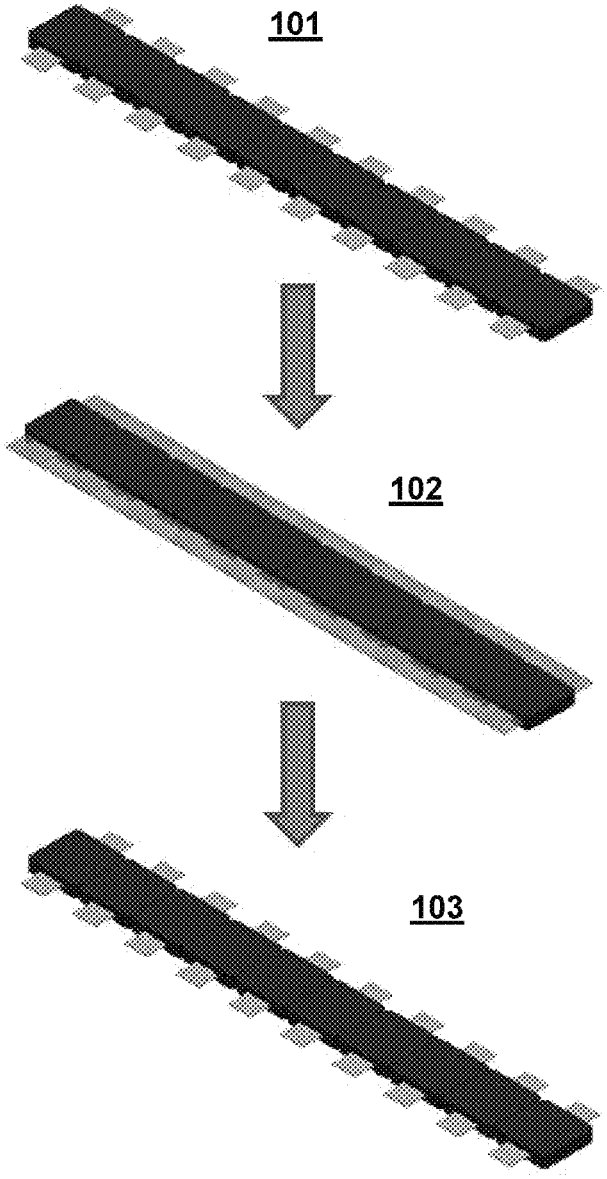
FIG. 1 (Prior Art)
FIG. 1 illustrates views of conventional steps of forming a paint-coating layer on the magnetic body of an inductor using an adhesive tape to cover the leads of an inductor.
Figure 2:
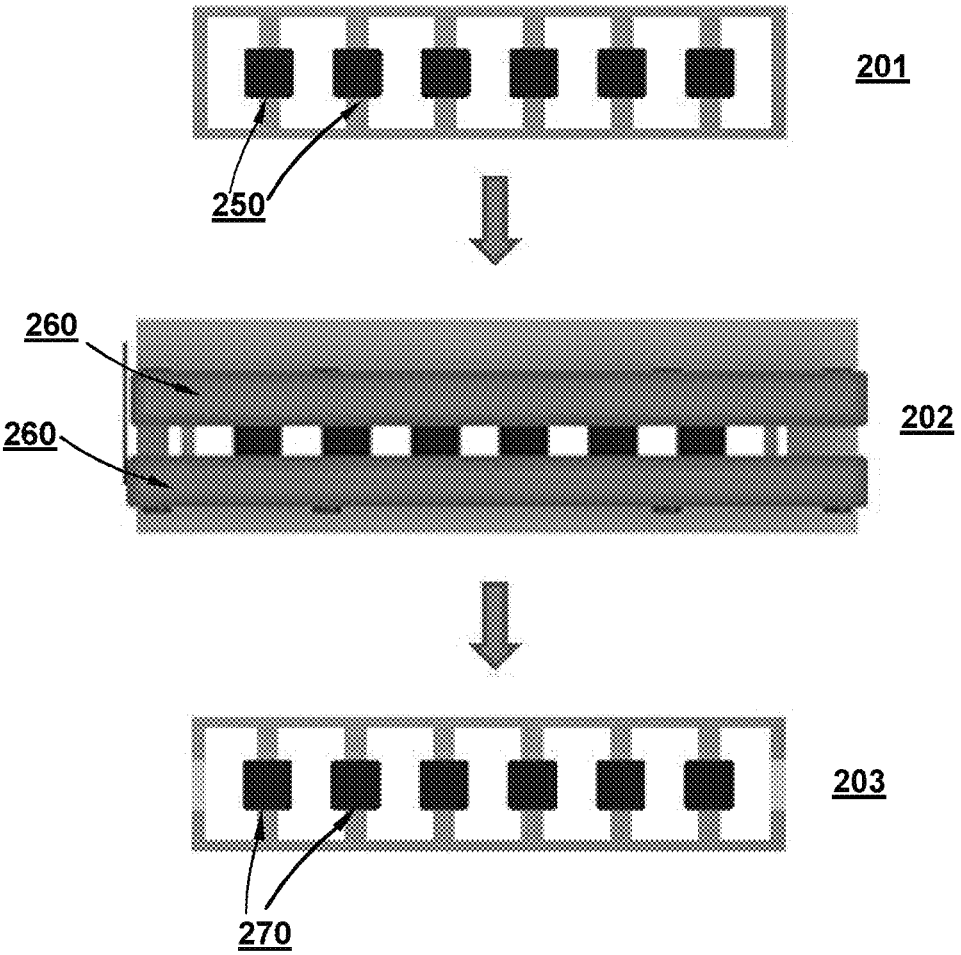
FIG. 2 illustrates views of steps of forming a paint-coating layer on the magnetic body of an inductor using a non-adhesive tape to cover the leads of an inductor according to an embodiment of the present invention.

Please refer to FIG. 2, which illustrates views of steps of forming a paint-coating layer on the magnetic body of an inductor using a non-adhesive tape to cover the leads of an inductor, wherein a view 201 shows the inductors 250 are made and are arranged on a frame before spraying paint on all surfaces of the magnetic body of each inductor 250; a view 202 shows the leads of inductors 250 on the frame are covered by a tape 260, wherein the tape 260 is not adhered to the leads by using the tape 260 that has no adhesive material on its bottom surface; and then spraying paint on the magnetic body to encapsulate all surfaces of the magnetic body of the inductor; and after the magnetic body is coated with the paint, the tape 260 can be easily removed because the tape 260 is not adhered to the leads; a view 203 shows the inductors 270 arranged on a frame after the magnetic body is coated with the paint for baking so that the paint can be heated and stayed on the magnetic body of each inductor. Because this method uses the non-sticky tape, unlike conventional technology using a sticky tape, there is no need to remove the glue after the non-sticky tape is removed, so it will not cause any structural damage to the inductor or choke body or the leads of the inductor. By doing so, it can save time and cost while having a much cleaner lead for connecting with an external circuit, because there is no glue attached on the leads for the whole process.

In one embodiment, a coil is embedded inside the magnetic body, and the coil is electrically connected to the first lead. In one embodiment, a coil is embedded inside the magnetic body, and the coil is electrically connected to the first lead and the second lead. In one embodiment, a metal strip is embedded inside the magnetic body and electrically connected to the first lead. In one embodiment, a metal strip is embedded inside the magnetic body and electrically connected to the first lead and the second lead.

Second Embodiment

This embodiment discloses a method to form a paint-coating layer on a magnetic body of an inductor, the method comprising: painting a body of an inductor having a first lead, wherein the first lead extends outside of the body of the inductor, covering the first lead with a fixture, wherein the fixture is not adhered to the first lead, spraying paint on all surfaces of the body of the inductor and removing said fixture to expose the first lead.

Figure 3:
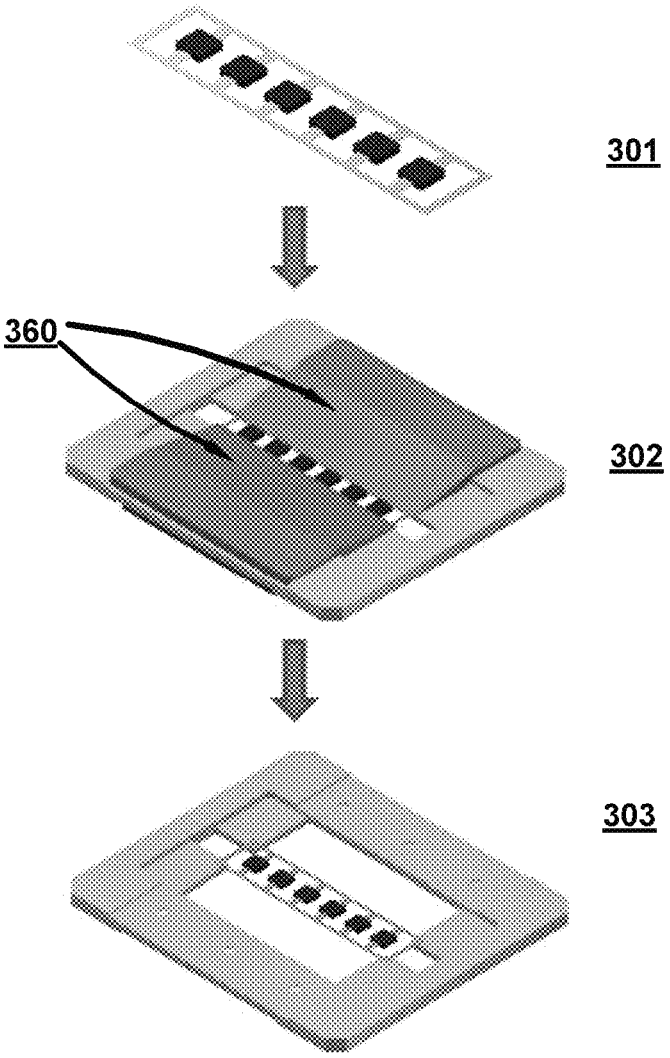
FIG. 3 illustrates views of steps of forming a paint-coating layer on the magnetic body of an inductor using a fixture to cover the leads of an inductor according to an embodiment of the present invention.

Please refer to FIG. 3, which illustrates views of steps of forming a paint-coating layer on the magnetic body of an inductor using a fixture to cover the leads of an inductor, wherein a view 301 shows the inductors are made and are arranged on a frame before spraying paint on all surfaces of the magnetic body of each inductor; a view 302 shows the leads of inductors on the frame are covered by a fixture, wherein the fixture is not adhered to the leads by using a fixture 360 that has no adhesive material on its bottom surface; and then spraying paint on the magnetic body to encapsulate all surfaces of the magnetic body of the inductor; and after the magnetic body is coated with the paint, the fixture 360 can be easily removed because the fixture 360 is not adhered to the leads; a view 303 shows the inductors arranged on a frame after the magnetic body is coated with the paint for baking so that the paint can be heated and stayed on the magnetic body of each inductor. Because this method uses the non-sticky fixture 360, unlike conventional technology using a sticky tape, there is no glue remained on the leads after the non-sticky fixture 360 is removed, so it will not cause any structural damage to the inductor or choke body or the leads of the inductor. The non-sticky fixture 360 can be more precise to define the area of the leads without being sprayed with paint, and the gap between the lead and the magnetic body can hence be narrowed, as a result, it will not cause solder-resistance issue when the lead is soldered with an external pad. By doing so, it can save time and cost while having a much cleaner lead for connecting with an external circuit, because there is no glue attached on the leads for the whole process.

In one embodiment, a coil is embedded inside the magnetic body, and the coil is electrically connected to the first lead. In one embodiment, a coil is embedded inside the magnetic body, and the coil is electrically connected to the first lead and the second lead. In one embodiment, a metal strip is embedded inside the magnetic body and electrically connected to the first lead. In one embodiment, a metal strip is embedded inside the magnetic body and electrically connected to the first lead and the second lead.

Third Embodiment

This embodiment discloses a method to form a paint-coating layer on a magnetic body of an inductor, wherein a lead extends out from a side surface of the body of the inductor, the method comprising: using an ultrasonic equipment to spray paint on all surfaces of the body of the inductor, wherein the lead is not covered while spraying the paint using the ultrasonic equipment.

Figure 4:
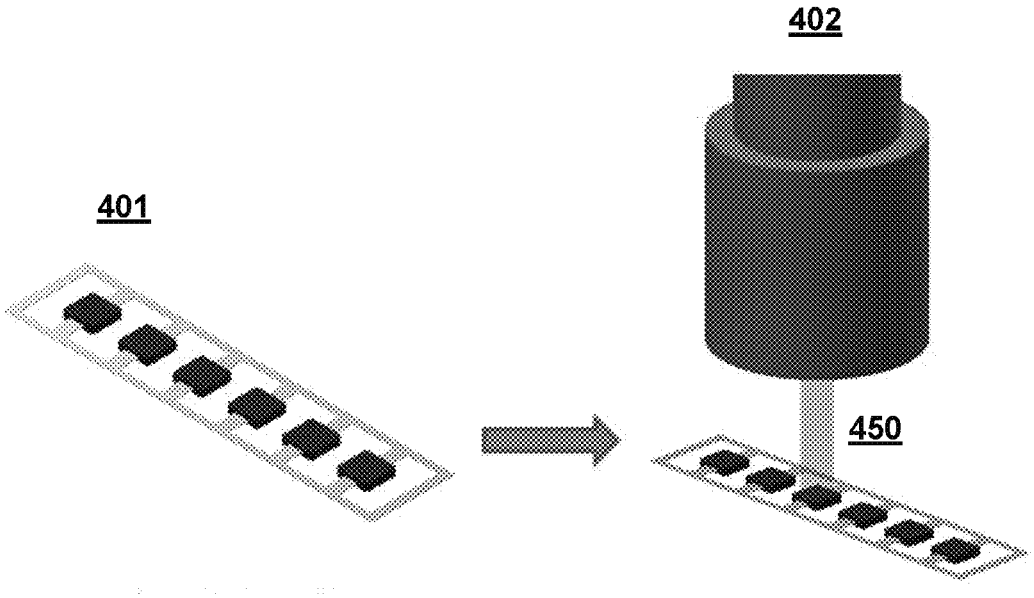
FIG. 4 illustrates views of steps of forming a paint-coating layer on the magnetic body of an inductor using an ultrasonic equipment according to an embodiment of the present invention.

Please refer to FIG. 4, which illustrates views of steps of forming a paint-coating layer on the magnetic body of an inductor, wherein a view 401 shows the inductors are made and are arranged on a frame before spraying paint on all surfaces of the magnetic body of each inductor; a view 402 shows the leads of inductors on the frame are not covered by any object; and then spraying paint 450 on the magnetic body to encapsulate all surfaces of the magnetic body of the inductor by using an ultrasonic equipment, ultrasonic equipment can generate a gas wall to control the range of paint spraying so that the leads will not be painted. The paint can be an anti-rust or insulating paint material, and the ultrasonic equipment can spray the paint directly onto the magnetic body of the inductor or choke. There is no need to cover the leads of the inductors when using the ultrasonic equipment to spraying the paint, and therefore, there is no need to have a supply material or any cleaning job of covering mask compared with the first and second embodiments described above. By doing so, it can save time and cost while having a much cleaner lead for connecting with an external circuit, because there is no glue attached on the leads for the whole process. This method is intended to improve the disadvantages of the second embodiment described above and it is suitable for various sizes of an inductor or a choke.

In one embodiment, a coil is embedded inside the magnetic body, and the coil is electrically connected to the first lead. In one embodiment, a coil is embedded inside the magnetic body, and the coil is electrically connected to the first lead and the second lead. In one embodiment, a metal strip is embedded inside the magnetic body and electrically connected to the first lead. In one embodiment, a metal strip is embedded inside the magnetic body and electrically connected to the first lead and the second lead.

Fourth Embodiment

Figure 5:
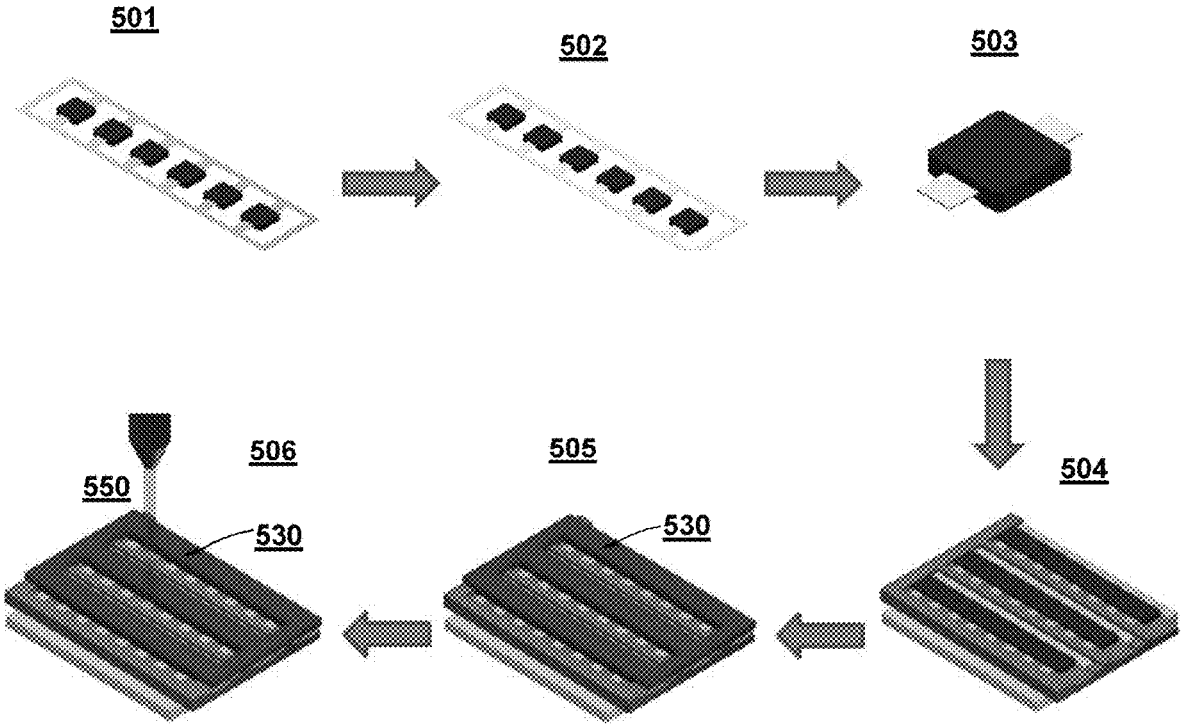
FIG. 5 illustrates views of steps of forming a paint-coating layer on the magnetic body of an inductor using a laser beam to remove the paint on the leads according to an embodiment of the present invention.

Please refer to FIG. 5, which illustrates views of steps to form a paint-coating layer on the magnetic body of an inductor, wherein a view 501 shows that the inductors are made and are arranged on a frame before spraying paint on all surfaces of the magnetic body of each inductor; and then spraying paint on the magnetic body to encapsulate all surfaces of the magnetic body of the inductor; a view 502 shows that the leads of inductors on the frame are coated with the paint; a view 503 shows the inductors are separated so that each inductor is separated from the others; a view 504 shows that the separated inductors are arranged on a frame; a view 505 shows that the leads are covered with a mask 530 to define a first area of a first surface of each lead for removing the paint on said first area; and a view 506 shows the paint on the first area of the first surface of each lead are removed by a laser beam 550. There is no cleaning job of the covering mask 530 because the laser beam 550 is very precise and the mask 530 will not get any stains of the paint, and hence the mask 530 can be reused without cleaning. The laser beam 550 can remove the paint very precisely according to the mask 530, and the gap between the lead and the magnetic body can hence be narrowed, as a result, it will not cause solder-resistance issue when the lead is soldered with an external pad. By doing so, it can save time and cost while have a much cleaner leads for connecting with an external circuit, because there is no glue attached on the leads for the whole process.

In one embodiment, a coil is embedded inside the magnetic body, and the coil is electrically connected to the first lead. In one embodiment, a coil is embedded inside the magnetic body, and the coil is electrically connected to the first lead and the second lead. In one embodiment, a metal strip is embedded inside the magnetic body and electrically connected to the first lead. In one embodiment, a metal strip is embedded inside the magnetic body and electrically connected to the first lead and the second lead.

Figure 6:
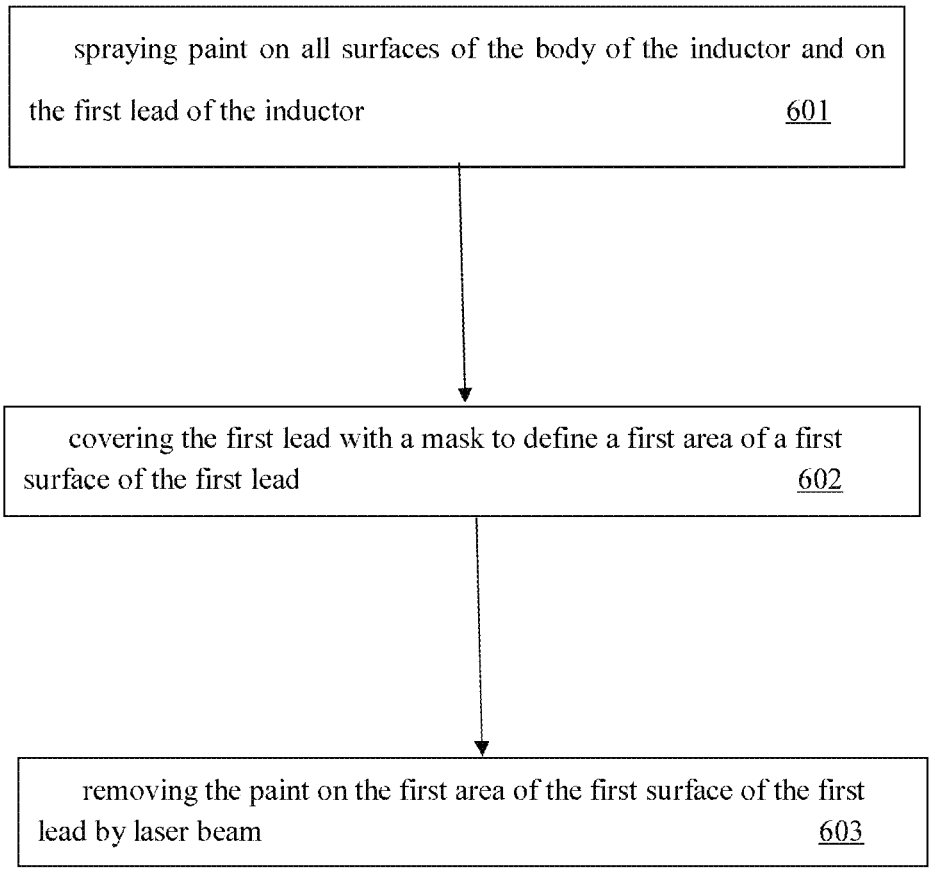
FIGS. 6-8 show different flow charts to form a paint-coating layer on the magnetic body of an inductor.

FIG. 6 shows a flow chart to perform a method to paint a body of an inductor, wherein a first lead extends out from a first side surface the body, in a step 601, spraying paint on all surfaces of the body of the inductor and on the first lead of the inductor; in a step 602, covering the first lead with a mask to define a first area of a first surface of the first lead; and in a step 603, removing the paint on the first area of the first surface of the first lead by laser beam.

In one embodiment, a coil is embedded inside the magnetic body, and the coil is electrically connected to the first lead. In one embodiment, a coil is embedded inside the magnetic body, and the coil is electrically connected to the first lead and the second lead. In one embodiment, a metal strip is embedded inside the magnetic body and electrically connected to the first lead. In one embodiment, a metal strip is embedded inside the magnetic body and electrically connected to the first lead and the second lead.

Figure 7:
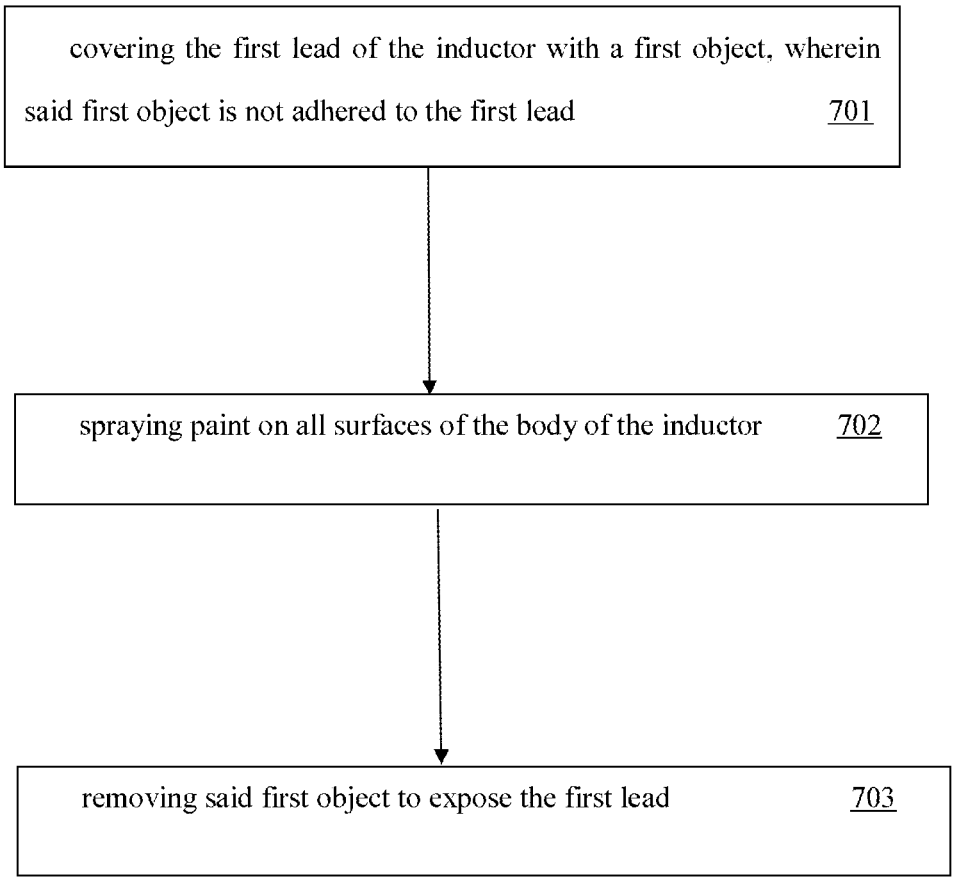

FIG. 7 shows a flow chart to perform a method to paint a body of an inductor, wherein a first lead extends outside from a first side surface of the body, in a step 701, covering the first lead of the inductor with a first object, wherein said first object is not adhered to the first lead; in a step 702, spraying paint on all surfaces of the body of the inductor; and in a step 703, removing said first object to expose the first lead.

In one embodiment, a coil is embedded inside the magnetic body, and the coil is electrically connected to the first lead. In one embodiment, a coil is embedded inside the magnetic body, and the coil is electrically connected to the first lead and the second lead. In one embodiment, a metal strip is embedded inside the magnetic body and electrically connected to the first lead. In one embodiment, a metal strip is embedded inside the magnetic body and electrically connected to the first lead and the second lead.

Figure 8:
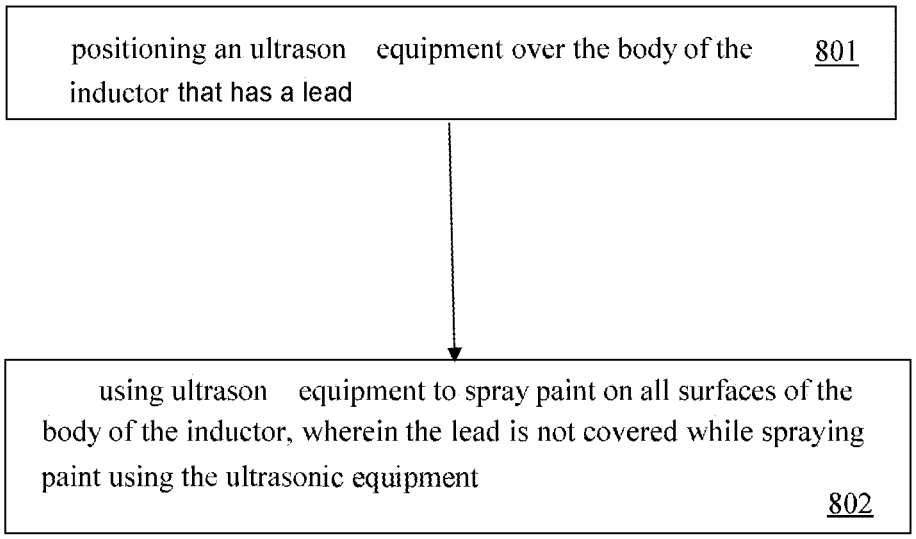

FIG. 8 shows a flow chart to perform a method to paint a body of an inductor, wherein a first lead extends outside from a first side surface of the body, in a step 801, positioning an ultra sound equipment over the body of the inductor; in a step 802, using an ultrasonic equipment to spray paint on all surfaces of the body of the inductor, wherein the lead is not covered while spraying the paint using the ultrasonic equipment.

In one embodiment, a coil is embedded inside the magnetic body, and the coil is electrically connected to the first lead. In one embodiment, a coil is embedded inside the magnetic body, and the coil is electrically connected to the first lead and the second lead. In one embodiment, a metal strip is embedded inside the magnetic body and electrically connected to the first lead. In one embodiment, a metal strip is embedded inside the magnetic body and electrically connected to the first lead and the second lead.

In one embodiment, an inductor is disclosed, the inductor comprising: a magnetic body, wherein a first lead extends outside of the body from a first side surface; and a paint-coating layer, formed by spraying paint on the magnetic body to encapsulate all surfaces of the magnetic body of the inductor, wherein the paint-coating layer extends from the first side surface of the magnetic body to a first area of a first surface of the first lead, and a second area of the first surface of the first lead is not covered by the paint-coating layer for electrically connecting with an external circuit.

In one embodiment, a second lead extends out from a second side surface the magnetic body of the inductor, wherein the first lead and the second lead extends outside of the magnetic body from two opposite side surfaces of the magnetic body, wherein the paint-coating layer extends from the second side surface to a first area of a second surface of the second lead, and a second area of the second surface of the second lead is not covered by the paint-coating layer for electrically connecting with an external circuit.

In one embodiment, a coil is embedded inside the magnetic body, and the coil is electrically connected to the first lead. In one embodiment, a coil is embedded inside the magnetic body, and the coil is electrically connected to the first lead and the second lead. In one embodiment, a metal strip is embedded inside the magnetic body and electrically connected to the first lead. In one embodiment, a metal strip is embedded inside the magnetic body and electrically connected to the first lead and the second lead.

The above disclosure is related to the detailed technical contents and inventive features thereof. People skilled in the art may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A method to paint a body of an inductor, wherein the outer surface of the body has six side surfaces, and a first lead extends out from a first side surface of the body of the inductor, the method comprising:

spraying paint on each of the six side surfaces of the outer surface of the body and the first lead of the inductor;

covering at least one portion of the inductor with a mask to define at least one first area for removing the paint sprayed on the first lead; and removing the paint in the at least one first area by a laser beam.

2. The inductor of claim 1, wherein a second lead extends out from a second side surface the body of the inductor, wherein the first lead and the second lead extend outside of the body from two opposite side surfaces of the body, further comprising: disposing the mask over the second lead to define at least one second area for removing the paint sprayed on the second lead; and removing the paint in the at least one second area by the laser beam.

3. The inductor of claim 2, wherein the body is a magnetic body, wherein a coil is embedded inside the magnetic body and electrically connected to the first lead and the second lead.

4. The inductor of claim 1, wherein the body is a magnetic body, wherein a metal strip is embedded inside the magnetic body and electrically connected to the first lead.

5. The inductor of claim 2, wherein the body is a magnetic body, wherein a metal strip is embedded inside the magnetic body and electrically connected to the first lead and the second lead.

6. A method to paint a body of an inductor, wherein the outer surface of the body has six side surfaces, and a first lead extends out from a first side surface of the body of the inductor, the method comprising:

covering the first lead of the inductor with a first object, wherein said first object is not adhered to the first lead;

spraying paint on each of the six side surfaces of the outer surface of the body of the inductor; and removing said first object to expose the first lead.

7. The method of claim 6, wherein said object is a non-adhesive tape.

8. The method of claim 6, wherein said object is a non-adhesive fixture.

9. The method of claim 6, wherein the inductor further comprises a second lead extending out from a second side surface of the body of the inductor, wherein the first lead and the second lead extend outside of the body from two opposite side surfaces of the body, further comprising covering the second lead with a second object, wherein the second object is not adhered to the second lead; and removing said second object to expose the second lead.

10. The method of claim 9, wherein said first object and said second object are integrally formed in one piece.

11. The method of claim 6, wherein the body is a magnetic body, wherein a coil is embedded inside the magnetic body and electrically connected to the first lead.

12. The method of claim 9, wherein the body is a magnetic body, wherein a coil is embedded inside the magnetic body and electrically connected to the first lead and the second lead.

13. The method of claim 6, wherein the body is a magnetic body, wherein a metal strip is embedded inside the magnetic body and electrically connected to the first lead.

14. The method of claim 9, wherein the body is a magnetic body, wherein a metal strip is embedded inside the magnetic body and electrically connected to the first lead and the second lead.

* * * * *